United States Patent [19]

Tamagawa et al.

[11] Patent Number: 4,771,031

[45] Date of Patent: Sep. 13, 1988

[54] HEAT-SENSITIVE RECORDING PAPER

[75] Inventors: Shigehisa Tamagawa; Tetsuro Fuchizawa, both of Shizuoka, Japan

[73] Assignee: Fuji Photo Film Co., Ltd., Kanagawa, Japan

[21] Appl. No.: 932,826

[22] Filed: Nov. 20, 1986

[30] Foreign Application Priority Data

Nov. 21, 1985 [JP] Japan ..... 60-262221

[51] Int. Cl.[4] ..... B41M 5/18

[52] U.S. Cl. ..... 503/200; 427/150; 427/151; 428/211; 428/539.5; 503/207; 503/226

[58] Field of Search ..... 346/200, 226; 427/150–152; 503/200, 207, 226; 428/211, 537.5, 913, 914

[56] References Cited

U.S. PATENT DOCUMENTS 4,148,968 4/1979 Nagashima et al. ..... 428/913

*Primary Examiner*—Bruce H. Hess

*Attorney, Agent, or Firm*—Sughrue, Mion, Zinn, Macpeak & Seas

[57] ABSTRACT

A heat-sensitive recording paper comprising a support having coated thereon a heat-sensitive color-forming layer, wherein the support contains an inorganic fiber.

10 Claims, No Drawings

HEAT-SENSITIVE RECORDING PAPER

FIELD OF THE INVENTION

The present invention relates to a heat-sensitive recording paper which is used to record, for example, with a thermal head or a heat pen. More particularly, it is concerned with a heat-sensitive recording paper which is free from the problem of a heat-sensitive color-forming layer adhering to the thermal head and accumulating on the thermal head, and permits recording images of high sharpness and high density even in high speed recording, and, furthermore, is reduced in curling.

BACKGROUND OF THE INVENTION

Recent advances in facsimile devices, including printers therefor, have been remarkable. In these devices, a heat-sensitive recording system that is widely used utilizes a combination of a thermal head and a heat-sensitive recording paper with a coating of a colorless dye such as crystal violet lactone and a phenol compound, as described, for example, in Japanese Patent Publication No. 14039/70.

The heat-sensitive recording system has many advantages. For example, since the recording paper is of the primary color formation type, a conventional type development step is not needed, and the recorded unit can be simplified. Therefore, the production costs for the recording paper and recording unit are low. Also, since recording is of the non-impact type, it is not noisy. Thus, heat-sensitive recording has gained a position as a low speed recording system. However, a major disadvantage of the heat-sensitive recording system is that it is low in recording speed compared with other recording systems, such as electrostatic recording. For this reason, the heat-sensitive recording system has not yet been employed in circumstances wherein high speed recording is required.

The main reason for which high speed recording cannot be attained by the heat-sensitive recording system is that heat conduction cannot be achieved sufficiently quickly between the thermal head and the heat-sensitive recording paper coming into contact with the thermal head, and, thus, sufficient recording density cannot be obtained if high speed recording is attempted. The thermal head, comprising electric resistor heat generators combined together in a dot form, generates heat upon receipt of a recording signal and melts a heat-sensitive color-forming layer in contact with the thermal head, thereby allowing it to form color. In order to attain recording of high sharpness and high density, it is necessary that dot reproductivity be good. That is, it is necessary that the thermal head and the heat-sensitive color-forming layer come into as close contact as possible and heat conduction be carried out with high efficiency so that a completely colored dot conforming to the shape of the dot heat generator of the thermal head is formed in the heat-sensitive color-forming layer in a manner completely correspondent to a high speed recording signal. In fact, however, only several percent of the amount of heat generated from the thermal head is conducted to the heat-sensitive color-forming layer; the efficiency of heat conduction is extremely low. Several methods have been proposed to increase the smoothness of the heat-sensitive color-forming layer so that the thermal head and the heat-sensitive color-forming layer come into as close contact as possible with each other.

Japanese Patent Publication No. 20142/77 describes a method in which the surface of the heat-sensitive color-forming layer is treated so that the surface smoothness as represented in terms of Beck smoothness is from 200 to 1,000 seconds. Japanese Patent Application (OPI) No. 115255/79 (the term "OPI" as used herein refers to a "published unexamined Japanese patent application") describes that when the Beck smoothness is from 200 to 1,000 seconds, the heat-sensitive color-forming layer can respond only to heat impulses of from about 5 to 6 milliseconds, and that for high speed recording using heat impulses of less than 1 millisecond it is necessary for the surface of the heat-sensitive color-forming layer to be made smooth to such an extent that the Beck smoothness is more than 1,100 seconds. However, when the Beck smoothness is increased to more than 1,100 seconds, color fog is produced upon application of pressure. The formation of color fog is prevented by using a base paper which has been previously made smooth to an extent that the Beck smoothness is more than 500 seconds. Japanese Patent Application (OPI) No. 156086/78 describes that the surface roughness, Ra, of the heat-sensitive color-forming layer is made to be less than 1.2 μm, and the glossiness less than 25%.

In all the above-described prior art techniques, the smoothness of the heat-sensitive color-forming layer is increased only by calender processings such as super calendering, machine calendering, and gloss calendering. This calendering is applied to the base paper alone, or the base paper and the heat-sensitive paper, or the heat-sensitive paper alone. In the heat-sensitive recording paper, however, as the smoothness is increased by the calendering in order to increase the recording density, adherence and accumulation are increased. In practical use, therefore, the smoothness is suppressed to a suitable level so that the recording density and the occurrence of adherence and accumulation are properly balanced. In the prior art techniques, regardless of the smoothness level, the resulting heat-sensitive recording paper is unsuitable for practical use for high speed recording in respect of recording density and recording stability.

The term "adherence" (sticking) as used herein refers to a phenomenon wherein the thermal head adheres to the heat-sensitive color-forming layer, thereby producing stripping noise and lowering the dot reproductivity. The term "accumulation" (piling) refers to a phenomenon wherein heat-melted products of the heat-sensitive color-forming layer accumulate on the thermal head, thereby lowering the recording density and dot reproductivity. Both of these phenomena inhibit stable recording.

Another disadvantage as encountered in applying the calender processing to the heat-sensitive recording paper is that color fog is formed by pressure, resulting in an increase in the density of the background of the recording paper. Similarly, in the calendering processing of the base paper, so-called cockle, wrinkles, etc., due to unevenness in basis weight develop. Thus, it is limited in its practical use. As described above, the attempt to increase the smoothness of the heat-sensitive color-forming layer by calendering processing so as to increase the recording density has met with only limited success, and the resulting heat-sensitive recording paper is not sufficiently satisfactory for use in high speed recording.

Furthermore, heat-sensitive recording paper is usually used in the condition that it is wound on a paper tube several inches in diameter. Thus, since it is stored in the above condition, curling at the core portion is liable to occur. It has long been desired to overcome this curling problem.

SUMMARY OF THE INVENTION

The present invention is intended to overcome the above-described problems, and an object of the present invention is to provide a heat-sensitive recording paper which produces a high recording density and is reduced in curling when stored in the condition that it is wound on a small paper tube.

As a result of concerted efforts made to eliminate these problems of the prior art heat-sensitive recording papers, the present inventors have found that a satisfactory product capable of attaining high recording density without experiencing excessive curl can be obtained by using a paper support made from a mixture of inorganic fibers and natural pulp fibers.

Accordingly, the present invention relates to a heat-sensitive recording paper comprising a support having coated thereon a heat-sensitive color-forming layer, wherein the support contains an inorganic fiber.

DETAILED DESCRIPTION OF THE INVENTION

A variety of inorganic fibers may be used in the present invention, including alumina fibers, silica fibers, alumina-silica fibers, boron fibers, potassium titanate fibers, glass fibers, carbon fibers, silicon carbide fibers, polyphosphazine fibers, and fibers chiefly comprising silicic acid and calcium oxide. An inorganic fiber used in the present invention is preferably an alumina-silica fiber, a silica fiber, a glass fiber, and a fiber chiefly comprising silicic acid and calcium, more preferably a glass fiber and a fiber chiefly comprising silicic acid and calcium, and most preferably a fiber chiefly comprising silicic acid and calcium. A preferred fiber length ranges from about 0.01 to about 30 mm, with fibers 0.05 to 10 mm long being particularly preferred. The strength of single fibers is desirably at least about 5 kg/mm$^2$, with the range of 10 to 30 kg/mm$^2$ being more preferred, in order to prevent curling during printing. The inorganic fibers are preferably mixed with natural pulp fibers in proportions of about 2 to about 80 wt%, with the range of 5 to 50 wt% being particularly preferred.

Any type of natural pulp may be employed in the present invention, such as hardwood pulp, softwood pulp, straw pulp, esparto pulp, bagasse pulp, etc. Hardwood pulp which is comprised of short fibers and which is readily provided with a high degree of smoothness is preferably used. The inorganic fibers are mixed with natural pulp after the latter is disintegrated in cold or lukewarm water by means of a pulper and beaten to a Canadian Standard Freeness (C.S.F.) of about 100 to about 400 cc.

A variety of additives may also be employed; sizing agents such as rosin, paraffin wax, higher aliphatic acid salts, alkenyl succinates, aliphatic acid anhydrides, styrene-maleic anhydride copolymers, alkyl ketene dimers, and epoxidized aliphatic acid amides; softening agents such as the reaction products of maleic anhydride copolymers and polyalkylene polyamines, the reaction products of urethane alcohols and alkylating agents, and quaternary ammonium salts of higher aliphatic acids; strength additives such as polyacrylamides, starches, polyvinyl alcohol gelatin, melamine-formaldehyde resins, urea-formaldehyde resins, polyethyleneimine resins, synthetic rubber lactices, polyacrylic acid ester emulsions, and polyvinyl acetate emulsions; fixing agents such as aluminum sulfate, aluminum chloride, and polyamidopolyamine-epichlorohydrin resins. Other additives such as dyes, fluorescent dyes, antistatic agents and defoamers may also be incorporated where required by the skilled artisan.

The support used in the present invention is made from a mixture of the aforementioned components on a Fourdrinier paper machine or a cylinder paper machine, and has a basis weight and a thickness within the ranges of about 30 to about 200 g/m$^2$ and about 40 to about 250 $\mu$m, respectively.

If desired, the paper support of the heat-sensitive recording paper of the present invention may be provided with a pigment-based primer coat.

The heat-sensitive coating solution as used herein will hereinafter be explained.

A color former and a color developer are dispersed independently in the respective water-soluble polymer solutions, for example, by means of a ball mill. In the case of the ball mill, a finely divided dispersion of the color former or color developer is prepared by using balls having different diameters in a suitable mixing ratio, and dispersing the resulting mixture over a sufficiently long period of time. It is also effective, for example, to use a model sand mill (trademark, Dyno mill).

The thus-prepared color former and color developer dispersions are mixed, and inorganic pigments, waxes, higher fatty acid amides, and metallic soaps, and, if desired, further, ultraviolet absorbers, antioxidants, latex binders, etc., are added thereto to prepare the desired coating solution. These additives may be added during the dispersing process.

The coating solution is coated on a support in such a manner that the amount of the color former coated is from 0.2 to 1.0 g/m$^2$.

The color former used herein is not critical; color formers commonly used in pressure-sensitive and heat-sensitive recording papers, for example, can be used in the present invention. Typical examples of such color formers are shown below.

(1) Triarylmethane-based compounds:

3,3-Bis(p-dimethylaminophenyl)-6-dimethylaminophthalide (crystal violet lactone), 3-(p-dimethylaminophenyl)-3-(1,2-dimethylindol-3-yl)phthalide, 3-(p-dimethylaminophenyl)-3-(2-phenylindol-3-yl)phthalide, 3,3-bis(p-ethylcarbazol-3-yl)-3-dimethylaminophthalide, and 3,3-bis(2-phenylindol-3-yl)-5-dimethylaminophthalide.

(2) Diphenylmethane-based compounds:

4,4-Bisdimethylaminobenzhydrin benzyl ether, N-halophenyl leucoauramine, and N-2,4,5-trichlorophenyl leucoauramine.

(3) Xanthene-base compounds:

Rhodamine B-anilinolactam, 3-diethylamino-7-dibenzylaminofluoran, 3-diethylamino-7-butylaminofluoran, 3-diethylamino-;b 7-(2-chloroanilino)fluoran, 3-diethylamino-6-methyl-7-anilinofluoran, 3-piperidino-6-methyl-7-anilinofluoran, 3-ethyltolylamino-6-methyl-7-anilinofluoran, 3-cyclohexylmethylamino-6-methyl-7-anilinofluoran, 3-diethylamino-6-chloro-7-($\beta$-ethoxyethyl)aminofluoran, 3-diethylamino-6-chloro-7-($\gamma$-chloropropyl)aminofluoran, 3-diethylamino-6-chloro-7-anilinofluoran, 3-N-cyclohexyl-N-methylamino-6-methyl-7-anilinofluoran, and 3-diethylamino-7-phenylfluoran.

(4) Thiazine-based compounds:

Benzoyl leucomethylene blue, and p-nitrobenzoyl leucomethylene blue.

(5) Spiro-based compounds:

3-Methyl-spirodinaphthopyran, 3-ethyl-spirodinaphthopyran, 3-benzyl-spirodinaphthopyran, and 3-methylnaphtho(3-methoxybenzo)spiropyran.

They can be used singly or in combination with each other. The color former is selected depending on the particular purpose of the heat-sensitive recording paper and the desired characteristics.

As color developers which are used in the present invention, phenol derivatives and aromatic carboxylic acid derivatives are preferred. Particularly preferred are bisphenols. Typical examples of such phenol compounds are p-octylphenol, p-tert-butylphenol, p-phenylphenol, 2,2-bis(p-hydroxy)propane, 1,1-bis(p-hydroxyphenyl)pentane, 1,1-bis(p-hydroxyphenyl)hexane, 2,2-bis(p-hydroxyphenyl)hexane, 1,1-bis(p-hydroxyphenyl)-2-ethylhexane, and 2,2-bis(4-hydroxy-3,5-dichlorophenyl)propane. Typical examples of aromatic carboxylic acid derivatives are p-hydroxybenzoic acid, propyl p-hydroxybenzoate, butyl p-hydroxybenzoate, benzyl p-hydroxybenzoate, 3,5-di-$\alpha$-methylbenzylsalicylic acid, and polyvalent metal salts thereof. The preferred amount of the color developer coated is from 0.5 to 2.0 g/m$^2$.

In order that the color developer melts at the desired temperature and undergoes a color-forming reaction, it is preferred that the color developer be added as an eutectic mixture in combination with a heat-fusible substance having a low melting point, or in the state that such a low melting substance is fused to the surface of color developer particles.

Waxes which can be used include paraffin wax, carnauba wax, microcrystalline wax, and polyethylene wax. In addition, higher fatty acid amides such as stearic acid amide, ethylenebisstearoamide, higher fatty acid esters, etc., can be used.

Metallic soaps which can be used include higher fatty acid polyvalent metal salts such as zinc stearate, aluminum stearate, calcium stearate, and zinc oleate.

Inorganic pigments which can be used include kaolin, calcined kaolin, talc, agalmatolite, diatomaceous earth, calcium carbonate, aluminum hydroxide, magnesium hydroxide, magnesium carbonate, titanium oxide, and barium carbonate.

For these inorganic pigments it is preferred that the amount of oil absorbed is at least 60 ml/100 g and the average particle diameter, 5 $\mu$m or less. In the case of oil-absorbing inorganic pigments, it is desirable that they be compounded in the recording layer in a dry amount of from 5 to 50% by weight, with the range of from 10 to 40% by weight being preferred.

They are dispersed in a binder and coated. In general, water-soluble binders are used for this purpose, including polyvinyl alcohol, hydroxyethyl cellulose, hydroxypropyl cellulose, an ethylene/maleic anhydride copolymer, a styrene/maleic anhydride copolymer, an isobutylene/maleic anhydride copolymer, polyacrylic acid, starch derivatives, casein, and gelatin.

Compounds for providing water resistance (i.e., gelling agents and crosslinking agents), and hydrophobic polymer emulsions such as a styrene/butadiene rubber latex and an acryl resin emulsion can be added for the purpose of imparting water resistance to the above binders.

The amount of the binder in the recording layer is from 10 to 30% by weight, indicated as dry weight. In addition, if desired, other auxiliary additives such as defoaming agents, fluorescent dyes, and coloring dyes may be added to the coating solution.

In the formation of the recording layer, the above coating solution can be coated by known coating techniques, such as blade coating, air knife coating, gravure coating, roll coating, spray coating, dip coating, bar coating, and extrusion coating.

The amount of the coating solution coated on the support is not critical; it is usually from 3 to 15 g/m$^2$, indicated as dry weight, with the range of from 4 to 10 g/m$^2$ being preferred.

The heat-sensitive recording paper of the present invention which employs a paper support containing inorganic fibers about 0.05 to about 10 mm in fiber length attains the following two specific advantages: first, it contacts a thermal head over an increased area so as to achieve a higher recording density and improved dot reproduction; secondly, the increased flexibility of the support reduces the chance of the heat-sensitive recording paper curling during an extended period of use.

The following examples are provided for the purpose of further illustrating the present invention but are in no sense to be taken as limiting the scope of this invention. Unless otherwise indicated, all parts, percents, ratios and the like are by weight.

EXAMPLES

To each of the mixtures of natural pulp and inorganic fibers shown in Table 1 below were added 1.0 part of a rosin sizing agent, 1.0 part of an anionic polyacrylamide and 2.0 parts of aluminum sulfate, all parts being based on the total weight of the natural pulp and inorganic fibers, and sheets having a basis weight of 60 g/m$^2$ and a thickness of 67 $\mu$m were formed on a Fourdrinier paper machine. Comparative sheets were formed by the same procedures except that no inorganic fibers were incorporated.

A heat-sensitive coating solution was coated on the base papers prepared both according to the present invention and comparative examples to produce heat-sensitive papers.

Preparation of Heat-Sensitive Coating Solution 20 kg of crystal violet lactone was placed in a 300-liter ball mill along with a 10% aqueous solution of polyvinyl alcohol (degree of saponification: 98%, degree of polymerization: 500), and dispersed therein over a 24 hour period. Similarly, 20 kg of 2,2-bis(4-hydroxyphenyl)propane was placed in a 300-liter ball mill along with a 10% aqueous solution of polyvinyl alcohol, and dispersed therein over a 24 hour period. The thus-prepared dispersions were mixed in such a manner that the weight ratio of crystal violet lactone to 2,2-bis(4-hydroxyphenyl)propane was 1:5. In addition, 5 kg of finely divided calcium carbonate was added to 20 kg of the above-prepared mixture and thoroughly dispersed to prepare the desired coating solution.

Coating of the Heat-Sensitive Coating Solution

The coating solution was coated on one surface of the base paper by the use of an air knife coater in a solid amount of 6 g/m$^2$, dried in a hot air drier maintained at 50° C., and machine calendered.

The above-produced heat-sensitive papers were subjected to heat-sensitive recording and measured for the recording density. The heat-sensitive papers were each wound on a paper pipe 2 inches in diameter and stored for 5 months at 20° C. and 60% RH (relative humidity). At the end of the period, they were evaluated for curling.

Recording and Measurement of Density

Solid coloration was performed under conditions of recording speed: 2 milliseconds per dot, recording density in a main direction: 5 dots/mm, recording density in a sub-scanning direction: 6 dots/mm, and energy of thermal head: 50 millijoules/mm$^2$. The recording density was determined by measuring reflective density at 610 nm.

The results are shown in Table 2 below.

TABLE 1

| Sample No. | Natural Pulp | Inorganic Fibers |
|---|---|---|
| 1 (Invention) | LBKP* (water freeness: 250 cc) 70% | Silicic acid/calcium oxide based fibers** (fiber length: 3 mm) 30% |
| 2 (Invention) | LBKP/NBKP* = 4/1 (water freeness: 280 cc) 80% | Silicic acid/calcium oxide based fibers** (fiber length: 0.15 mm) 20% |
| 3 (Invention) | LBKP/NBKP = 4/1 (water freeness: 300 cc) 80% | Glass fibers (fiber length: 1 mm) 20% |
| 4 (Comparison) | LBKP/NBKP = 4/1 (water freeness: 280 cc) 100% | — |
| 5 (Comparison) | LBKP/NBKP = 3/1 (water freeness: 250 cc) 100% | — |

*LBKP = Laub Holy Bleached Kraft Pulp
NBKP = Needle-Leaved Bleached Kraft Pulp
**CMF of Nippon Cement Co., Ltd.

TABLE 2

| Sample No. | Recording Density | Dot Reproduction | Curl*** |
|---|---|---|---|
| 1 (Invention) | 1.26 | Excellent | 9 |
| 2 (Invention) | 1.18 | Excellent | 15 |
| 3 (Invention) | 1.20 | Excellent | 13 |
| 4 (Comparison) | 1.01 | Good | 33 |
| 5 (Comparison) | 0.94 | Good | 41 |

***The average of elevations at the four corners of A4 size paper.

As the data in Table 2 show, the samples of heat-sensitive recording paper prepared in accordance with the present invention exhibited excellent properties not only in terms of color density but also with respect to dot reproduction and anti-curl properties.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper, which is used to record with a thermal head or a heat pen, comprising a support having coated thereon a heat-sensitive color-forming layer, wherein said support contains a mixture of inorganic fibers and natural pulp fibers, and said heat-sensitive color-former layer contains both a color former and a color developer.

2. A heat-sensitive recording paper according to claim 1, wherein said inorganic fibers are selected from the group consisting of alumina fibers, silica fibers, alumina-silica fibers, boron fibers, potassium titanate fibers, glass fibers, carbon fibers, silicon carbide fibers, polyphosphazine fibers, and fibers chiefly comprising silicic acid and calcium oxide.

3. A heat-sensitive recording paper according to claim 1, wherein the length of said fibers is from about 0.01 to about 30 mm.

4. A heat-sensitive recording paper according to claim 1, wherein the length of said fibers is from 0.05 to 10 mm.

5. A heat-sensitive recording paper according to claim 1, wherein the strength of individual inorganic fibers is at least about 5 kg/mm$^2$.

6. A heat-sensitive recording paper according to claim 1, wherein said inorganic fibers are mixed with natural pulp fibers in proportions of about 2 to about 80 wt%, based on said natural pulp fibers.

7. A heat-sensitive recording paper according to claim 6, wherein said natural pulp is selected from the group consisting of hardwood pulp, softwood pulp, straw pulp, esparto pulp, and bagasse pulp.

8. A heat-sensitive recording paper according to claim 1, wherein said support has a thickness within the range of about 40 to about 250 μm and a basis weight of about 30 to 200 g/m$^2$.

9. A heat-sensitive recording paper according to claim 1, wherein said color-forming layer comprises a color former selected from the group consisting of triarylmethane compounds, diphenylmethane compounds, xanthene compounds, thiazine compounds, and spiropyran compounds, alone or in combination.

10. A heat-sensitive recording paper according to claim 1, wherein said color-forming layer comprises color developers selected from the group consisting of phenolic derivatives and aromatic carboxylic acid derivatives.

* * * * *